US011267097B2

(12) United States Patent
Otsu et al.

(10) Patent No.: US 11,267,097 B2
(45) Date of Patent: Mar. 8, 2022

(54) NON-TRANSITORY COMPUTER-READABLE STORAGE MEDIUM STORING A PROGRAM OF STRETCHING OPERATION OF ELASTIC MEMBRANE, METHOD OF STRETCHING OPERATION OF ELASTIC MEMBRANE, AND POLISHING APPARATUS

(71) Applicant: EBARA CORPORATION, Tokyo (JP)

(72) Inventors: Kazuya Otsu, Tokyo (JP); Koichi Takeda, Tokyo (JP); Kunimasa Matsushita, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 666 days.

(21) Appl. No.: 16/164,273

(22) Filed: Oct. 18, 2018

(65) Prior Publication Data

US 2019/0118330 A1 Apr. 25, 2019

(30) Foreign Application Priority Data

Oct. 25, 2017 (JP) ..... JP2017-205803
Oct. 5, 2018 (JP) ..... JP2018-190269

(51) Int. Cl.

| | |
|---|---|
| ***B24B 37/005*** | (2012.01) |
| ***B24B 37/32*** | (2012.01) |
| ***B24B 37/10*** | (2012.01) |
| ***B24B 37/04*** | (2012.01) |
| ***B24B 57/02*** | (2006.01) |

(52) U.S. Cl.

CPC ..... *B24B 37/005* (2013.01); *B24B 37/042* (2013.01); *B24B 37/107* (2013.01); *B24B 37/32* (2013.01); *B24B 57/02* (2013.01)

(58) Field of Classification Search

CPC ..... B24B 37/27; B24B 37/30; B24B 37/32; B24B 37/005; B24B 37/042; B24B 37/10; B24B 49/16; B24B 49/08; B24B 49/183

See application file for complete search history.

(56) References Cited

U.S. PATENT DOCUMENTS 6,354,922 B1 * 3/2002 Sakurai ..... B24B 37/042 257/E21.23
8,332,064 B2 12/2012 Torikoshi et al.
(Continued)

FOREIGN PATENT DOCUMENTS

JP 2000-202765 A 7/2000
JP 2007-075973 A 3/2007

*Primary Examiner* — Joel D Crandall
(74) *Attorney, Agent, or Firm* — Pearne & Gordon LLP

(57) ABSTRACT

A non-transitory computer-readable storage medium storing a program of stretching operation of an elastic membrane which can enhance elasticity of an elastic membrane in a short time without using a dummy wafer is disclosed. The non-transitory computer-readable storage medium storing a program of stretching operation of an elastic membrane in a substrate holding apparatus, the program causes a computer to perform stretching operation of supplying a pressurized fluid to a pressure chamber formed by the elastic membrane and allowing the pressure chamber to be open to the atmosphere a predetermined number of times by a pressure regulating device in a state where the substrate holding apparatus is positioned above a polishing table during standby operation of a polishing apparatus.

14 Claims, 9 Drawing Sheets

(56) References Cited

U.S. PATENT DOCUMENTS

| | | | | |
|---|---|---|---|---|
| 2005/0054266 | A1* | 3/2005 | Togawa | B24B 49/16<br>451/5 |
| 2009/0142995 | A1* | 6/2009 | Hsu | F16K 11/0876<br>451/60 |
| 2011/0159783 | A1* | 6/2011 | Fukushima | B24B 49/12<br>451/11 |

* cited by examiner

FIG. 8

| Items | Line Items | NODP | Initial Values | Max | min |
|---|---|---|---|---|---|
| Membrane Break-in | Interval Time [min] | | | | |
| | Set Value | | | | |
| Membrane Height | Set Value[min] | | | | |
| Time to Free Air Bag | Set Value [s] | | | | |
| Area 1Air Bag (Center 1 Air Bag) | Valve Open Time [s] | | | | |
| | #of Times [time] | | | | |
| | Set Value [hPa] | | | | |
| Area2 Air Bag (Center 2 Air Bag) | Valve Open Time [s] | | | | |
| | #of Times [time] | | | | |
| | Set Value [hPa] | | | | |
| Area3 Air Bag | Valve Open Time [s] | | | | |
| | #of Times [time] | | | | |
| | Set Value [hPa] | | | | |
| Area4 Air Bag (Ripple Air Bag) | Valve Open Time [s] | | | | |
| | #of Times [time] | | | | |
| | Set Value [hPa] | | | | |
| Area5 Air Bag | Valve Open Time [s] | | | | |
| | #of Times [time] | | | | |
| | Set Value [hPa] | | | | |
| Area6 Air Bag (Outer Air Bag) | Valve Open Time [s] | | | | |
| | #of Times [time] | | | | |
| | Set Value [hPa] | | | | |
| Area7 Air Bag | Valve Open Time [s] | | | | |
| | #of Times [time] | | | | |
| | Set Value [hPa] | | | | |
| Area8 Air Bag (Edge Air Bag) | Valve Open Time [s] | | | | |
| | #of Times [time] | | | | |
| | Set Value [hPa] | | | | |

200 201 202 203 204 205

NON-TRANSITORY COMPUTER-READABLE STORAGE MEDIUM STORING A PROGRAM OF STRETCHING OPERATION OF ELASTIC MEMBRANE, METHOD OF STRETCHING OPERATION OF ELASTIC MEMBRANE, AND POLISHING APPARATUS

CROSS REFERENCE TO RELATED APPLICATIONS

This document claims priorities to Japanese Patent Application Number 2017-205803 filed Oct. 25, 2017 and Japanese Patent Application Number 2018-190269 filed Oct. 5, 2018, the entire contents of which are hereby incorporated by reference.

BACKGROUND

A polishing apparatus for performing CMP has a polishing table that supports a polishing pad thereon, and a substrate holding apparatus, which is called a top ring or a polishing head, for holding a wafer. When the wafer is polished using such polishing apparatus, the substrate holding apparatus holds the wafer and presses the wafer against a polishing surface of the polishing pad at a predetermined pressure. At this time, the polishing table and the substrate holding apparatus are moved relative to each other to bring the wafer into sliding contact with the polishing surface, thereby polishing a surface of the wafer.

During polishing of the wafer, if a relative pressing force applied between the wafer and the polishing surface of the polishing pad is not uniform over the entire surface of the wafer, insufficient polishing or excessive polishing would occur depending on a pressing force applied to each portion of the wafer. Thus, in order to make the pressing force against the wafer uniform, the substrate holding apparatus has a pressure chamber formed by a flexible elastic membrane (membrane) at a lower part thereof. This pressure chamber is supplied with a fluid such as air to press the wafer through the elastic membrane with a fluid pressure.

In the case where the elastic membrane of the substrate holding apparatus is replaced as occasion arises, such as maintenance, because a newly replaced elastic membrane does not have sufficient elasticity (flexibility), a pressurized fluid is supplied to the pressure chamber formed by the elastic membrane and the pressure chamber is open to the atmosphere (i.e., supply of the pressurized fluid to the pressure chamber and opening of the pressure chamber to the atmosphere are performed), thereby enhancing elasticity of the newly replaced elastic membrane.

In order to perform the supply of the pressurized fluid to the pressure chamber formed by the elastic membrane and the opening of the pressure chamber to the atmosphere, a program (recipe) for performing processing of the wafer is produced, and a dummy wafer (Non Product Wafer) is automatically transferred and the processing of the dummy wafer is performed according to the produced recipe. The supply of the pressurized fluid to the pressure chamber formed by the elastic membrane and the opening of the pressure chamber to the atmosphere are performed during this processing.

However, because the number of times that the dummy wafer is used is limited, in order to enhance the elasticity of the new elastic membrane by performing processing of the dummy wafer, a large number of dummy wafers are required to be consumed, thus increasing cost.

Further, in the case where the supply of the pressurized fluid to the pressure chamber and the opening of the pressure chamber to the atmosphere are performed during the processing of the dummy wafer according to the recipe, the dummy wafer is required to undergo a sequence of processes (including at least a polishing process, a cleaning process and a drying process), thus requiring a long time.

SUMMARY OF THE INVENTION

According to an embodiment, there is provided a non-transitory computer-readable storage medium storing a program of stretching operation of an elastic membrane which can enhance elasticity of an elastic membrane in a short time without using a dummy wafer. Further, according to an embodiment, there is provided a method of stretching operation of the elastic membrane. Furthermore, according to an embodiment, there is provided a polishing apparatus for performing the stretching operation of the elastic membrane.

Embodiments, which will be described below, relate to a program for performing stretching operation of an elastic membrane used in a substrate holding apparatus configured to hold a substrate such as a wafer, a method for performing the stretching operation of the elastic membrane, and a polishing apparatus.

In an embodiment, there is provided a non-transitory computer-readable storage medium storing a program of stretching operation of an elastic membrane in a substrate holding apparatus, the program for causing a computer to perform steps comprising: performing stretching operation of supplying a pressurized fluid to a pressure chamber formed by the elastic membrane and allowing the pressure chamber to be open to the atmosphere a predetermined number of times by a pressure regulating device in a state where the substrate holding apparatus is positioned above a polishing table during standby operation of a polishing apparatus.

In a preferred embodiment, the program for causing the computer to perform steps comprising: performing operation of moving the substrate holding apparatus coupled to a swingable head arm from a standby position to a position above the polishing table by a swing device; performing operation of lowering the substrate holding apparatus attached to a vertically movable head shaft to a predetermined lower position by a vertically moving device; performing the stretching operation by the pressure regulating device; performing operation of elevating the substrate holding apparatus by the vertically moving device after completion of the stretching operation; and performing operation of moving the substrate holding apparatus to the standby position by the swing device.

In a preferred embodiment, the predetermined lower position is a position where the elastic membrane is brought into contact with a polishing pad supported by the polishing table at the time of supplying the pressurized fluid to the pressure chamber formed by the elastic membrane.

In a preferred embodiment, the program for causing the computer to perform steps comprising: performing a cleaning process for cleaning a processing liquid supply line by a flushing device; and performing the stretching operation before and/or after the cleaning process by the pressure regulating device.

In an embodiment, there is provided a method of stretching operation of an elastic membrane in a substrate holding apparatus, comprising: performing stretching operation of supplying a pressurized fluid to a pressure chamber formed by the elastic membrane and allowing the pressure chamber to be open to the atmosphere a predetermined number of times in a state where the substrate holding apparatus is positioned above a polishing table during standby operation of a polishing apparatus.

In a preferred embodiment, the method comprises: moving the substrate holding apparatus coupled to a swingable head aim from a standby position to a position above the polishing table; lowering the substrate holding apparatus attached to a vertically movable head shaft to a predetermined lower position; performing the stretching operation; elevating the substrate holding apparatus by the head shaft after completion of the stretching operation; and moving the substrate holding apparatus to the standby position by the head anti.

In a preferred embodiment, the predetermined lower position is a position where the elastic membrane is brought into contact with a polishing pad supported by the polishing table at the time of supplying the pressurized fluid to the pressure chamber formed by the elastic membrane.

In a preferred embodiment, the method further comprises: performing a cleaning process for cleaning a processing liquid supply line; and performing the stretching operation before and/or after the cleaning process.

In an embodiment, there is provided a polishing apparatus comprising: a polishing table configured to support a polishing pad; a substrate holding apparatus configured to hold a substrate and to press the substrate against the polishing pad on the polishing table; a pressure regulating device configured to perform stretching operation of supplying a pressurized fluid to a pressure chamber formed by an elastic membrane in the substrate holding apparatus and allowing the pressure chamber to be open to the atmosphere; and a controller configured to perform the stretching operation a predetermined number of times by the pressure regulating device in a state where the substrate holding apparatus is positioned above the polishing table during standby operation of a polishing apparatus.

In a preferred embodiment, the polishing apparatus further comprises: a swing device configured to swing the substrate holding apparatus coupled to a swingable head arm; and a vertically moving device configured to move the substrate holding apparatus attached to a vertically movable head shaft vertically; wherein the controller causes: the swing device to perform operation of moving the substrate holding apparatus from a standby position to a position above the polishing table; the vertically moving device to perform operation of lowering the substrate holding apparatus to a predetermined lower position; the pressure regulating device to perform the stretching operation; the vertically moving device to perform operation of elevating the substrate holding apparatus after completion of the stretching operation; and the swing device to perform operation of moving the substrate holding apparatus to the standby position.

In a preferred embodiment, the predetermined lower position is a position where the elastic membrane is brought into contact with the polishing pad at the time of supplying the pressurized fluid to the pressure chamber formed by the elastic membrane.

In a preferred embodiment, the polishing apparatus further comprises: a flushing device configured to perform a cleaning process for cleaning a processing liquid supply line to which a processing liquid supply nozzle for supplying a processing liquid onto the polishing pad is connected; wherein the controller causes: the flushing device to perform the cleaning process; and the pressure regulating device to perform the stretching operation before and/or after the cleaning process.

According to the above-described embodiments, it is not necessary to perform the stretching operation of the elastic membrane during processing of the wafer (or dummy wafer), and thus the cost caused by the consumption of the wafer (or dummy wafer) can be reduced and the elasticity of the elastic membrane can be enhanced in a short time.

BRIEF DESCRIPTION OF THE DRAWINGS

FIG. 8 is a view showing a setting image of dummy dispense which relates to the operating conditions of the stretching operation of the elastic membrane introduced into the controller.

DESCRIPTION OF EMBODIMENTS

Figure 1:
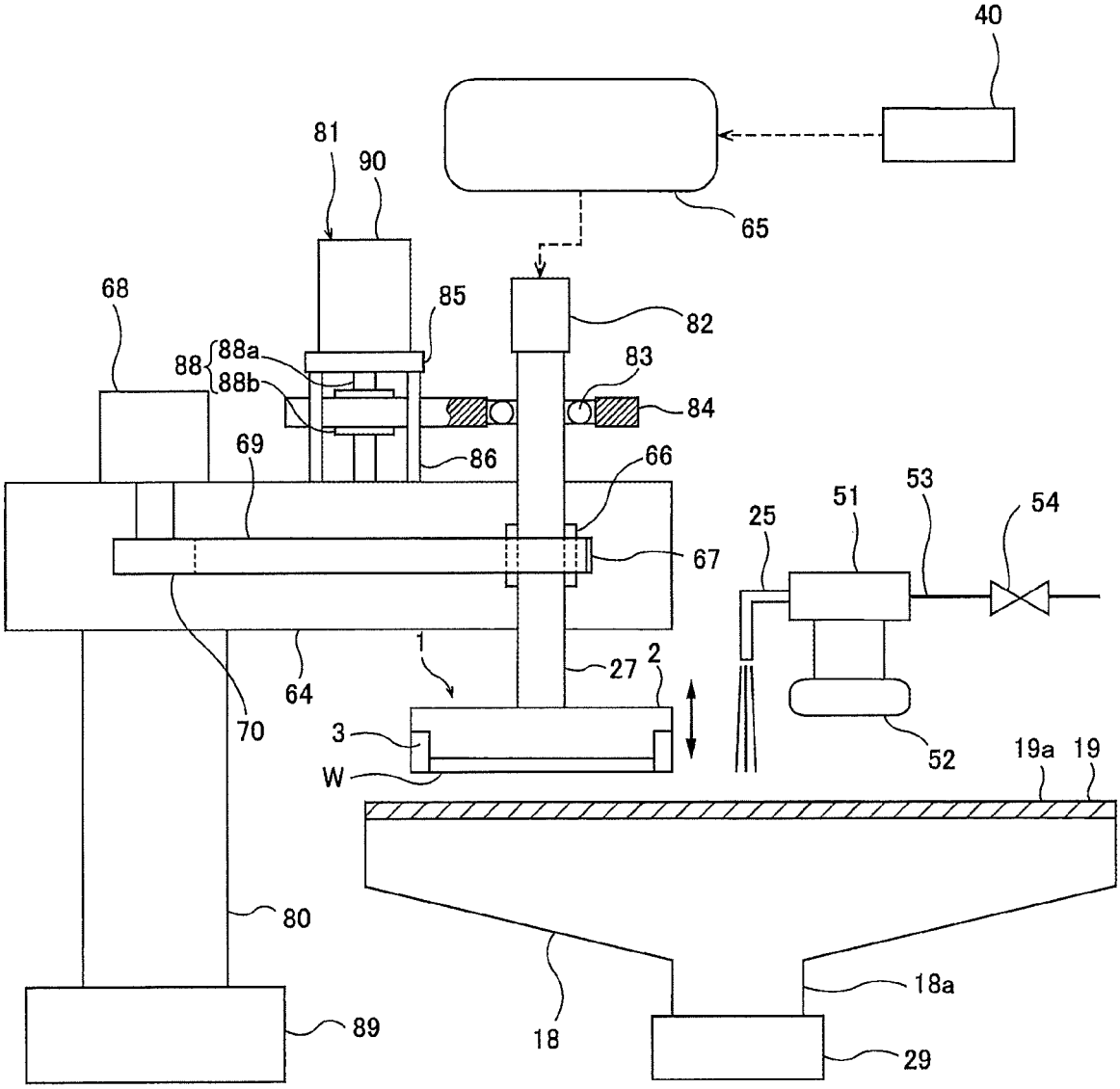
FIG. 1 is a view showing a polishing apparatus according to an embodiment.

Embodiments will be described below with reference to the drawings. FIG. 1 is a view showing a polishing apparatus according to an embodiment. As shown in FIG. 1, the polishing apparatus includes a polishing table 18 for supporting a polishing pad 19, and a polishing head (substrate holding apparatus) 1 for holding a wafer W as an example of a substrate, which is an object to be polished, and pressing the wafer W against the polishing pad 19 on the polishing table 18.

The polishing table 18 is coupled via a table shaft 18*a* to a table motor 29 disposed below the polishing table 18, so that the polishing table 18 is rotatable about the table shaft 18*a*. The polishing pad 19 is attached to an upper surface of the polishing table 18. A surface 19*a* of the polishing pad 19 serves as a polishing surface for polishing the wafer W. The polishing pad 19 is supported by the polishing table 18.

A processing liquid supply nozzle 25 is provided above the polishing table 18 so that the processing liquid supply nozzle 25 supplies a processing liquid comprising a polishing liquid or a cleaning liquid (e.g., pure water) or other liquid onto the polishing pad 19 on the polishing table 18.

The polishing head 1 includes a head body 2 for pressing the wafer W against the polishing surface 19*a*, and a retaining ring 3 for retaining the wafer W therein so as to prevent the wafer W from slipping out of the polishing head 1. The polishing head 1 is coupled to a head shaft 27, which is vertically movable relative to a head arm 64 by a vertically moving device 81. This vertical movement of the head shaft 27 causes the entirety of the polishing head 1 to move vertically relative to the head arm 64 and enables positioning of the polishing head 1. A rotary joint 82 is mounted to an upper end of the head shaft 27.

The vertically moving device 81 for elevating and lowering the head shaft 27 and the polishing head 1 includes a bridge 84 that rotatably supports the head shaft 27 through a bearing 83, a ball screw 88 mounted to the bridge 84, a support pedestal 85 supported by support posts 86, and a servomotor 90 mounted to the support pedestal 85. The support pedestal 85, which supports the servomotor 90, is fixedly mounted to the head arm 64 through the support posts 86.

The ball screw 88 includes a screw shaft 88*a* coupled to the servomotor 90 and a nut 88*b* that engages with the screw shaft 88*a*. The head shaft 27 is vertically movable together with the bridge 84. When the servomotor 90 is set in motion, the bridge 84 moves vertically through the ball screw 88, so that the head shaft 27 and the polishing head 1 move vertically.

The head shaft 27 is coupled to a rotary sleeve 66 by a key (not shown). A timing pulley 67 is secured to an outer circumferential portion of the rotary sleeve 66. A head motor 68 is fixed to the head arm 64. The timing pulley 67 is coupled through a timing belt 69 to a timing pulley 70, which is mounted to the head motor 68. When the head motor 68 is set in motion, the rotary sleeve 66 and the head shaft 27 are rotated integrally through the timing pulley 70, the timing belt 69, and the timing pulley 67, thus rotating the polishing head 1. The head arm 64 is supported by an arm shaft 80, which is rotatably supported by a frame (not shown). The polishing apparatus includes a controller 40 for controlling respective devices provided in the apparatus including the head motor 68, the servomotor 90 and the vertically moving device 81.

The polishing head 1 is configured to be able to hold the wafer W on its lower surface. The head arm 64 is coupled through an arm shaft 80 to an arm motor 89 disposed below the head arm 64, and the head arm 64 is rotatable about the arm shaft 80. The controller 40 is electronically connected to the arm motor 89 and is configured to control the arm motor 89 serving as a swing device for swinging the polishing head 1.

The head arm 64 is configured to be swingable about the arm shaft 80. Thus, the polishing head 1, which holds the wafer W on its lower surface, is moved from a position at which the polishing head 1 receives the wafer W (standby position) to a position above the polishing pad 19 by a swing motion of the head arm 64.

The processing liquid supply nozzle 25 is fixed to a nozzle swing shaft 51, and the processing liquid supply nozzle 25 is swingable about the nozzle swing shaft 51. The nozzle swing shaft 51 is coupled to a nozzle motor 52, and the processing liquid supply nozzle 25 is configured to be movable between a retreat position outside the polishing pad 19 and a processing position above the polishing pad 19. The controller 40 is electrically connected to the nozzle motor 52, and thus the operation of the nozzle motor 52 is controlled by the controller 40.

The processing liquid supply nozzle 25 is connected to a processing liquid supply line 53, and a processing liquid supply valve 54 is attached to the processing liquid supply line 53. The processing liquid supply valve 54 is electrically connected to the controller 40, and thus opening and closing operation of the processing liquid supply valve 54 is controlled by the controller 40.

When the processing liquid supply valve 54 is opened, the processing liquid (cleaning liquid or polishing liquid) is supplied onto the surface 19*a* of the polishing pad 19 through the processing liquid supply line 53 and the processing liquid supply nozzle 25. When the processing liquid supply valve 54 is closed, the supply of the processing liquid is stopped.

The processing for cleaning the processing liquid supply line 53 and the processing liquid supply nozzle 25 is performed by a flushing device. The flushing device is a cleaning device for cleaning the processing liquid supply line 53 and the processing liquid supply nozzle 25. The flushing device includes the nozzle motor 52 and the processing liquid supply valve 54. The flushing device performs the processing for cleaning the processing liquid supply line 53 and the processing liquid supply nozzle 25 by opening the processing liquid supply valve 54 according to a command from the controller 40 to flow the processing liquid in the processing liquid supply line 53 and the processing liquid supply nozzle 25.

The wafer W is polished in the following manner. The polishing head 1 and the polishing table 18 are rotated, respectively, and the polishing liquid is supplied onto the polishing pad 19 from the processing liquid supply nozzle 25 provided above the polishing table 18. In this state, the polishing head 1 is lowered to a predetermined position (predetermined height), and the wafer W is pressed against the polishing surface 19*a* of the polishing pad 19 at the predetermined position. The wafer W is brought into sliding contact with the polishing surface 19*a* of the polishing pad 19, and thus the surface of the wafer W is polished.

Figure 2:
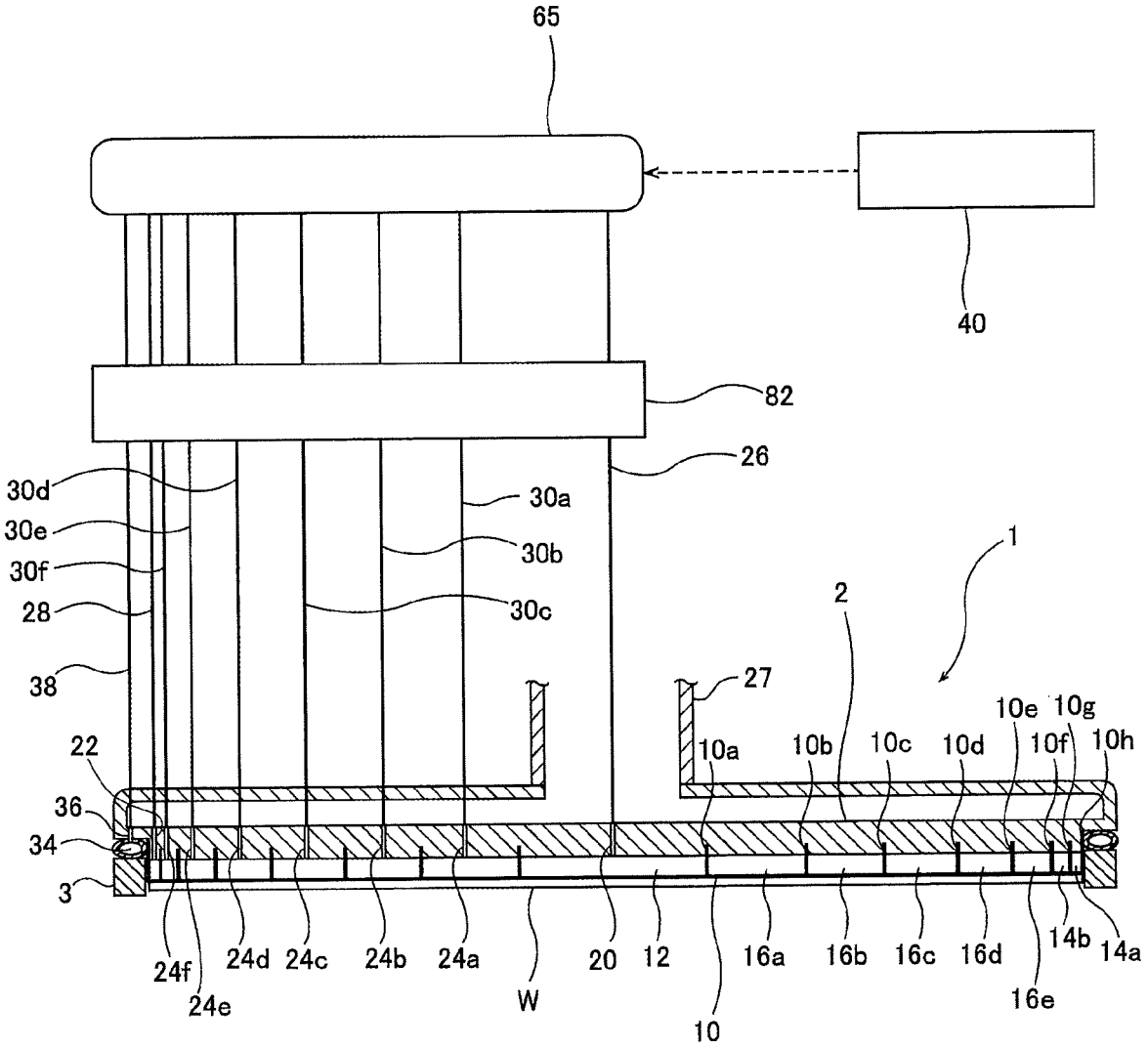
FIG. 2 is a cross-sectional view showing a polishing head.

Next, the polishing head (substrate holding apparatus) 1, which is installed in the polishing apparatus shown in FIG. 1, will be described in detail with reference to FIG. 2. FIG. 2 is a cross-sectional view showing the polishing head 1. As shown in FIG. 2, the polishing head 1 basically comprises the head body 2 which is secured to a lower end of the head shaft 27, the retaining ring 3 for directly pressing the polishing surface 19*a*, and an elastic membrane (membrane) 10 for pressing the wafer W against the polishing surface 19*a*. The retaining ring 3 is disposed so as to surround the wafer W and the elastic membrane 10, and is coupled to the head body 2. The elastic membrane 10 is attached to the head body 2 so as to cover a lower surface of the head body 2.

The elastic membrane 10 has a plurality of (eight in the drawing) annular circumferential walls 10*a*, 10*b*, 10*c*, 10*d*, 10*e*, 10*f*, 10*g* and 10*h* which are arranged concentrically. These circumferential walls 10*a*, 10*b*, 10*c*, 10*d*, 10*e*, 10*f*, 10*g* and 10*h* form a circular central pressure chamber 12 located at a center of the elastic membrane 10, annular edge pressure chambers 14*a*, 14*b* located at the outermost part of the elastic membrane 10, and five (in this embodiment) annular intermediate pressure chambers (i.e., first to fifth intermediate pressure chambers) 16*a*, 16*b*, 16*c*, 16*d* and 16*e* located between the central pressure chamber 12 and the edge pressure chambers 14*a*, 14*b*. These pressure chambers 12, 14*a*, 14*b*, 16*a*, 16*b*, 16*c*, 16*d* and 16*e* are located between an upper surface of the elastic membrane 10 and the lower surface of the head body 2. In the present embodiment, the number of pressure chambers formed by the elastic membrane 10 is eight, but the number of pressure chambers is not limited to the present embodiment. The number of pressure chambers may be increased or decreased according to the configuration of the elastic membrane 10.

The head body 2 has a fluid passage 20 communicating with the central pressure chamber 12, a fluid passage 22 communicating with the edge pressure chamber 14*a*, a fluid passage 24*f* communicating with the edge pressure chamber 14*b*, and fluid passages 24*a*, 24*b*, 24*c*, 24*d* and 24*e* communicating with the intermediate pressure chambers 16*a*, 16*b*, 16*c*, 16*d* and 16*e*, respectively. These fluid passages 20, 22, 24*a*, 24*b*, 24*c*, 24*d*, 24*e* and 24*f* are connected to fluid lines 26, 28, 30*a*, 30*b*, 30*c*, 30*d*, 30*e* and 30*f*, respectively, all of which are connected through the rotary joint 82 to a pressure regulating device 65. The pressure regulating device 65 is electrically connected to the controller 40, and thus the controller 40 can control the pressure regulating device 65.

A retainer chamber 34 is formed immediately above the retaining ring 3. This retainer chamber 34 is connected via a fluid passage 36 formed in the head body 2 and a fluid line 38 to the pressure regulating device 65.

According to the polishing head 1 configured as shown in FIG. 2, pressures of the pressurized fluid supplied to the respective pressure chambers 12, 14*a*, 14*b*, 16*a*, 16*b*, 16*c*, 16*d* and 16*e* are controlled, respectively, in a state where the wafer W is held by the polishing head 1, so that the polishing head 1 can press the wafer W with different pressures that are transmitted through multiple areas of the elastic membrane 10 arrayed along a radial direction of the wafer W. Thus, in the polishing head 1, pressing forces applied to the wafer W can be adjusted at multiple zones of the wafer W by adjusting pressures of the pressurized fluid supplied to the respective pressure chambers 12, 14*a*, 14*b*, 16*a*, 16*b*, 16*c*, 16*d* and 16*e* formed between the head body 2 and the elastic membrane 10. At the same time, a pressing force for pressing the polishing pad 19 by the retaining ring 3 can be adjusted by adjusting a pressure of the pressurized fluid supplied to the retainer chamber 34.

The head body 2 is made of resin such as engineering plastic (e.g., PEEK), and the elastic membrane 10 is made of a highly strong and durable rubber material such as ethylene propylene rubber (EPDM), polyurethane rubber, silicone rubber, or the like.

Figure 3:
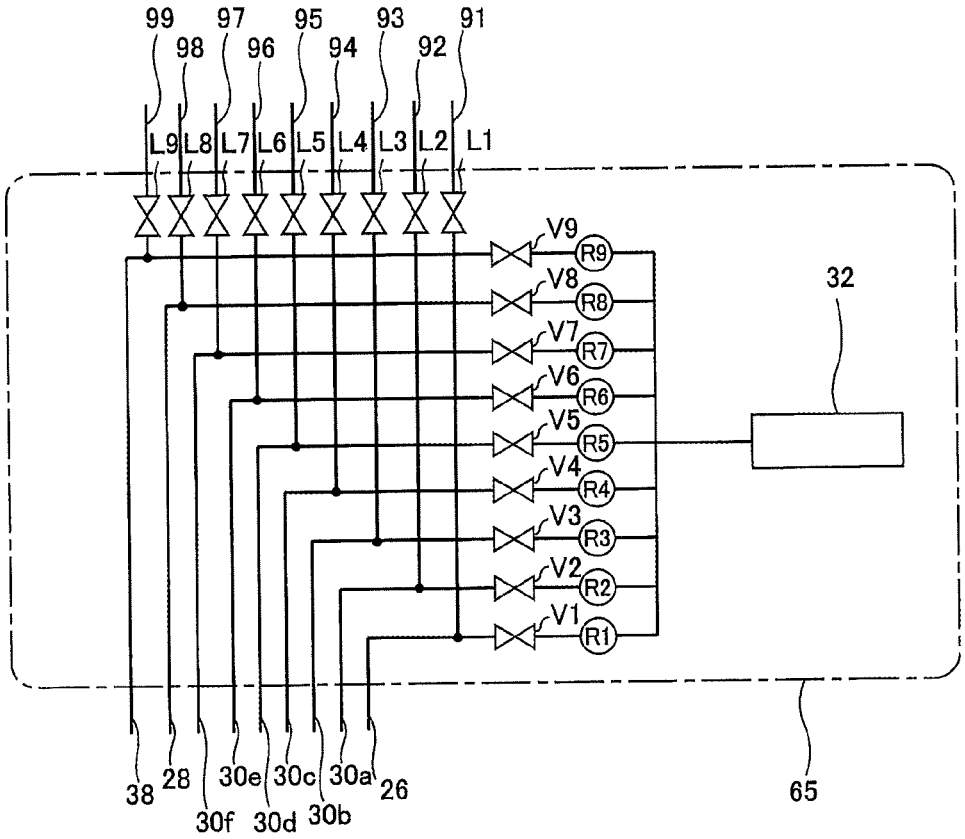
FIG. 3 is a schematic view showing a pressure regulating device.

The details of the pressure regulating device 65 will be described with reference to FIG. 3. FIG. 3 is a schematic view showing the pressure regulating device 65. As shown in FIG. 3, opening and closing valves V1, V2, V3, V4, V5, V6, V7, V8 and V9 and pressure regulators R1, R2, R3, R4, R5, R6, R7, R8 and R9 are provided respectively in fluid lines 26, 28, 30*a*, 30*b*, 30*c*, 30*d*, 30*e*, 30*f* and 38.

As shown in FIG. 2, the fluid passages 20, 22, 24*a*, 24*b*, 24*c*, 24*d*, 24*e*, 24*f* and 36 communicating with the respective pressure chambers are connected to the fluid lines 26, 28, 30*a*, 30*b*, 30*c*, 30*d*, 30*e*, 30*f* and 38, respectively. As shown in FIG. 3, the fluid lines 26, 28, 30*a*, 30*b*, 30*c*, 30*d*, 30*e*, 30*f* and 38 are connected to a fluid supply source 32.

Pressure release lines 91, 92, 93, 94, 95, 96, 97, 98 and 99 are connected to the fluid lines 26, 30*a*, 30*b*, 30*c*, 30*d*, 30*e*, 30*f*, 28 and 38, respectively. Pressure release valves L1, L2, L3, L4, L5, L6, L7, L8 and L9 are attached to the pressure release lines 91, 92, 93, 94, 95, 96, 97, 98 and 99, respectively.

The pressure regulators R1, R2, R3, R4, R5, R6, R7, R8 and R9 have a pressure regulating function for regulating pressures of the pressurized fluid supplied from the fluid supply source 32 to the pressure chambers 12, 14*a*, 14*b*, 16*a*, 16*b*, 16*c*, 16*d* and 16*e* and the retainer chamber 34, respectively. The pressure regulators R1-R9, the opening and closing valves V1-V9, and the pressure release valves L1-L9 are connected to the controller 40, and thus operations of these pressure regulators and these valves are controlled by the controller 40. When the pressure release valves L1-L9 are operated, the respective chambers 12, 14*a*, 14*b*, 16*a*-16*e*, and 34 are open to the atmosphere and become atmospheric pressure.

Although not shown in the drawing, vacuum lines are connected to the fluid lines 26, 28, 30*a*, 30*b*, 30*c*, 30*d*, 30*e*, 30*f* and 38, respectively, and negative pressure is formed in the respective chambers 12, 14*a*, 14*b*, 16*a*-16*e*, and 34 through these vacuum lines. Thus, the respective chambers 12, 14*a*, 14*b*, 16*a*-16*e*, and 34 are regulated into one of pressurized state, negative pressure state, and atmospheric pressure state by the pressure regulating device 65.

When a vacuum is formed in the intermediate pressure chamber 16*c* in a state where the wafer W is brought in contact with the lower surface of the elastic membrane 10, the wafer W is held by the polishing head 1 by vacuum attraction. Further, when the pressurized fluid is supplied to the intermediate pressure chamber 16*c* in a state where the wafer W is separated from the polishing pad 19, the wafer W is released from the polishing head 1.

In the case where the elastic membrane 10 is replaced as occasion arises, such as maintenance, because a newly replaced elastic membrane 10 does not have sufficient elasticity (flexibility), it is necessary to enhance the elasticity of the elastic membrane 10 by supplying the pressurized fluid to the respective pressure chambers 12, 14*a*, 14*b*, and 16*a*-16*e* and by allowing the respective pressure chambers 12, 14*a*, 14*b*, and 16*a*-16*e* to be open to the atmosphere. Hereinafter, in the present specification, operation of supplying the pressurized fluid to the respective pressure chambers 12, 14*a*, 14*b*, and 16*a*-16*e* and allowing the respective pressure chambers 12, 14*a*, 14*b*, and 16*a*-16*e* to be open to the atmosphere in a state where a wafer (including a dummy wafer) is not held by the polishing head 1, i.e., the wafer is not brought in contact with the elastic membrane 10 is referred to as stretching operation (pre-conditioning operation). By performing the stretching operation of the elastic membrane 10, the elasticity (flexibility) of the elastic membrane 10 can be enhanced, and thus the pressing force applied to the wafer W can be uniformized. As a result, the surface of the wafer W can be stably polished.

Figure 4:
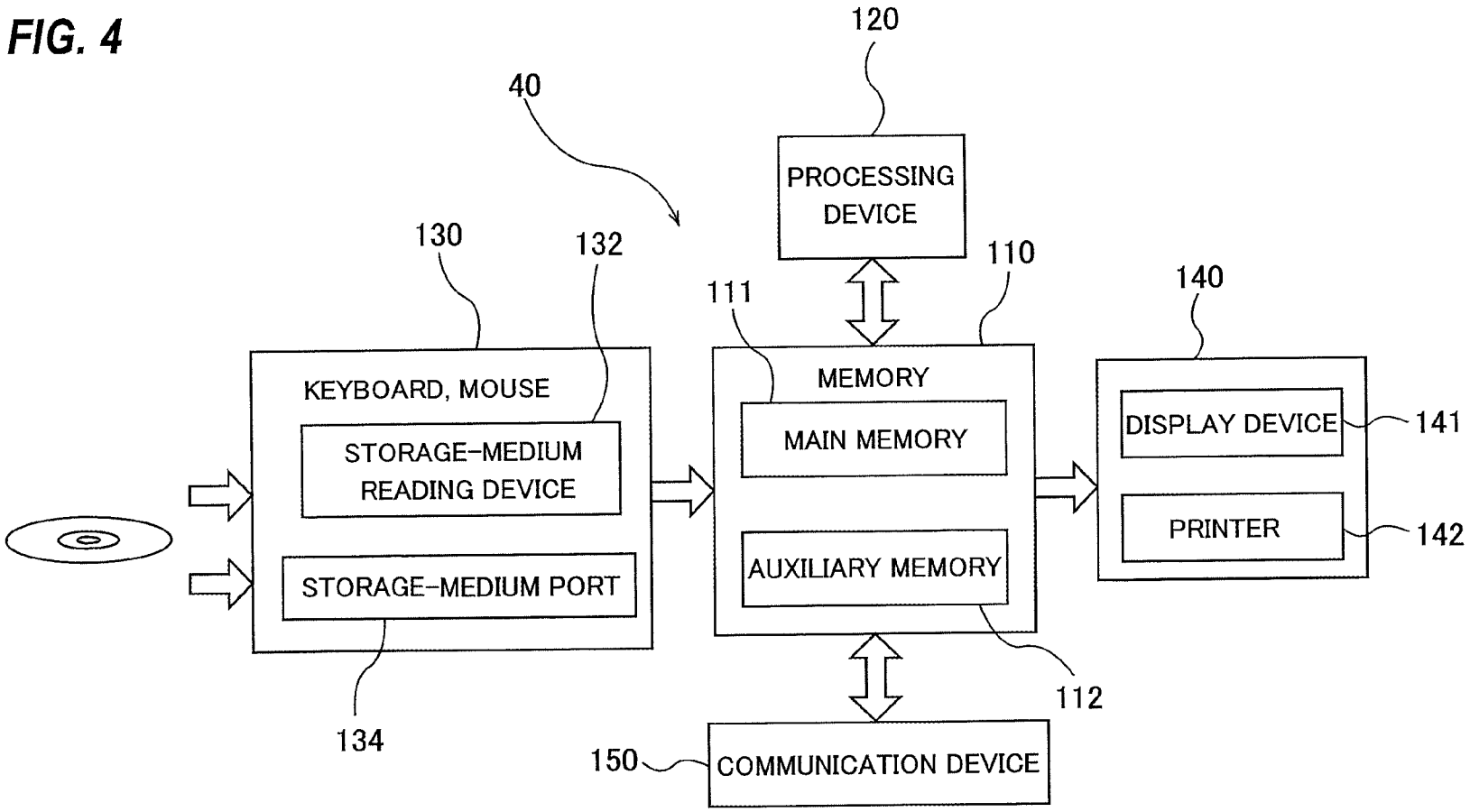
FIG. 4 is a schematic view showing a configuration of a controller.

The stretching operation of the elastic membrane 10 is controlled by the controller 40. In the present embodiment, the controller 40 is constituted by a dedicated computer or a general-purpose computer. FIG. 4 is a schematic view showing a configuration of the controller 40. The controller 40 includes a memory 110 in which a program and data are stored, a processing device 120 such as CPU (central processing unit) for performing arithmetic operation according to the program stored in the memory 110, an input device 130 for inputting the data, the program, and various information into the memory 110, an output device 140 for outputting processing results and processed data, and a communication device 150 for connecting to a network such as the Internet.

The memory 110 includes a main memory 111 which is accessible by the processing device 120, and an auxiliary memory 112 that stores the data and the program therein. The main memory 111 may be a random-access memory (RAM), and the auxiliary memory 112 is a storage device which may be a hard disk drive (HDD) or a solid-state drive (SSD).

The input device 130 includes a keyboard and a mouse, and further includes a storage-medium reading device 132 for reading the data from a storage medium, and a storage-medium port 134 to which a storage medium can be connected. The storage medium is a non-transitory tangible computer-readable storage medium. Examples of the storage medium include optical disk (e.g., CD-ROM, DVD-ROM) and semiconductor memory (e.g., USB flash drive, memory card). Examples of the storage-medium reading device 132 include optical drive (e.g., CD-ROM drive, DVD-ROM drive) and card reader. Examples of the storage-medium port 134 include USB port. The program and/or the data stored in the storage medium is introduced into the controller 40 via the input device 130, and is stored in the auxiliary memory 112 of the memory 110. The output device 140 includes a display device 141 and a printer 142. The controller 40 operates according to the program electrically stored in the memory 110.

Figure 5:
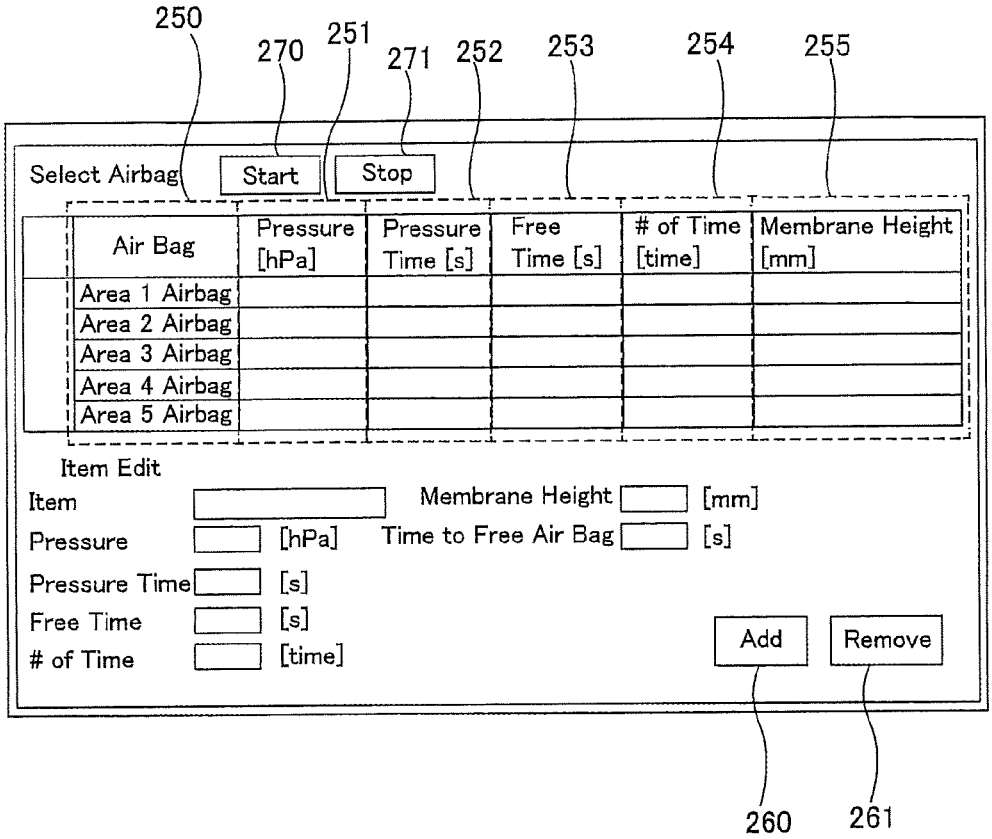
FIG. 5 is a view showing a setting image for setting operating conditions of stretching operation of an elastic membrane.
Figure 6:
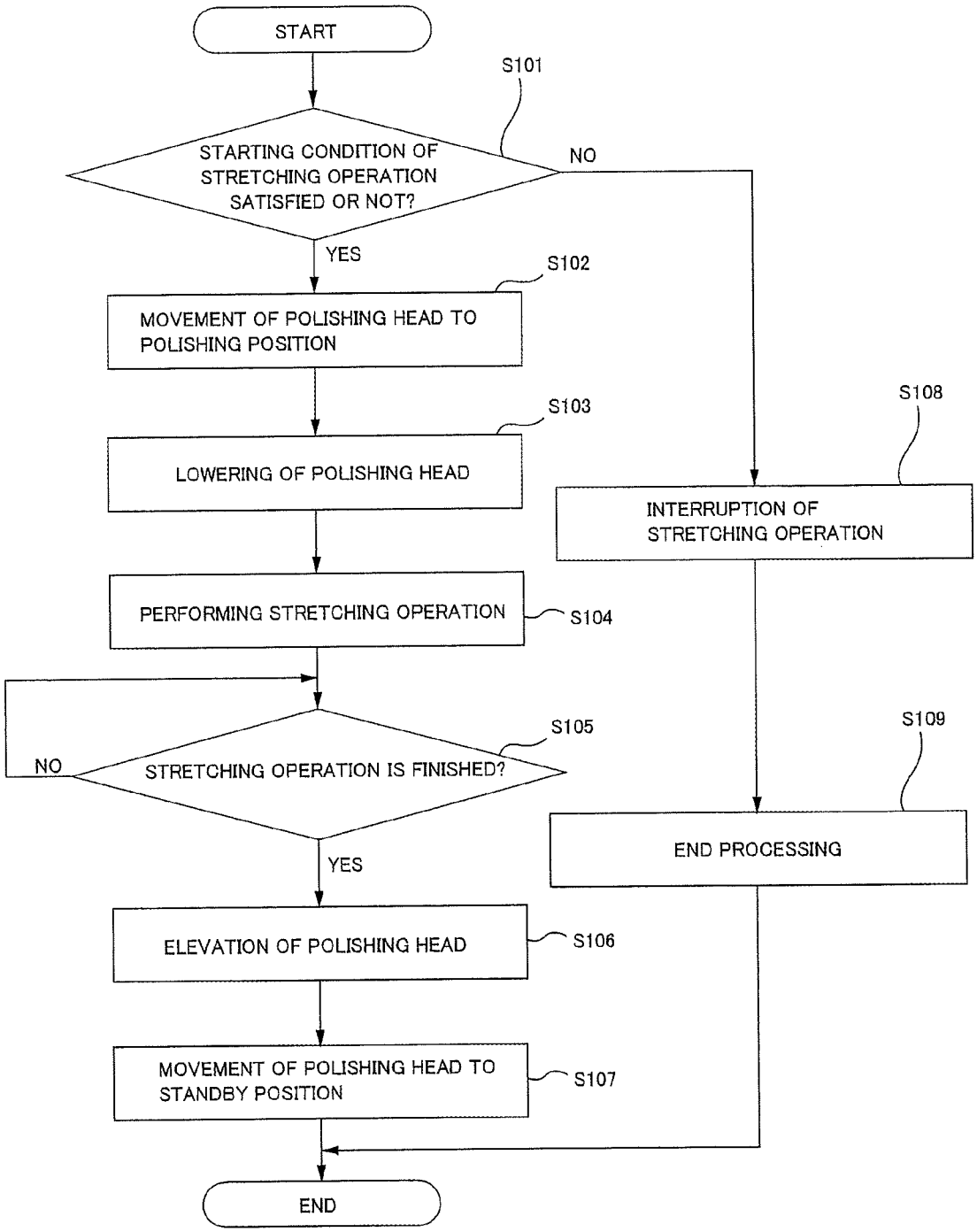
FIG. 6 is a view showing a processing flow of the controller which operates according to a program of stretching operation of the elastic membrane.
Figure 7:
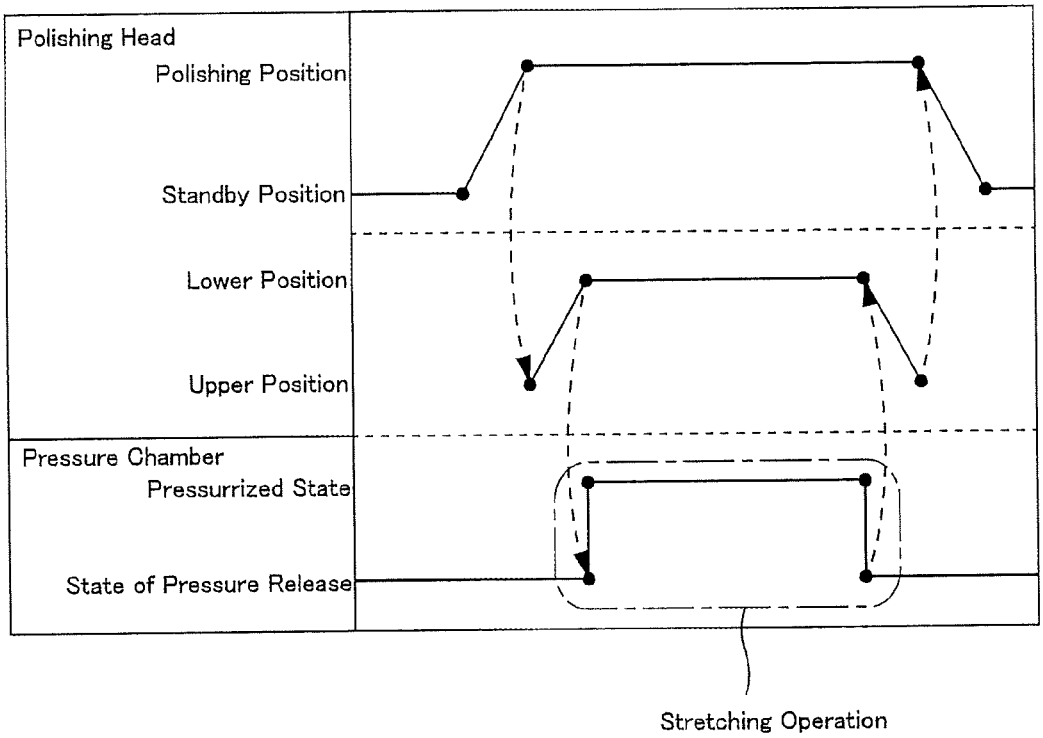
FIG. 7 is a view showing operation of the polishing apparatus controlled by the controller.

FIG. 5 is a view showing a setting image for setting operating conditions of the stretching operation of the elastic membrane 10. FIG. 6 is a view showing a processing flow of the controller 40 which operates according to a program of stretching operation of the elastic membrane 10. FIG. 7 is a view showing operation of the polishing apparatus controlled by the controller 40.

As shown in FIG. 5, the setting image for setting operating conditions of the stretching operation is displayed on a display screen of the display device 141. Setting value display columns which include a column 250 for showing pressure chambers as objects of the stretching operation, a column 251 for showing pressure values of the pressurized fluid supplied to the pressure chambers as the objects of the stretching operation, a column 252 for showing supply time of the pressurized fluid, a column 253 for showing time for the pressure chamber to be open to the atmosphere, a column 254 for showing repeat count of the stretching operation, and a column 255 for showing numerical values of the membrane height are displayed at the upper part of the setting image. In FIG. 5, concrete numerical values are not displayed in the above columns.

The operator can set operating conditions of the stretching operation through the input device 130. Setting value input items for setting the operating conditions of the stretching operation are displayed at the lower part of the setting image. When the pressure chamber as an object of the stretching operation is newly added, the operator selects an addition button 260 displayed on the setting image through the input device 130. When the pressure chamber as an object of the stretching operation is removed, the operator determines the pressure chamber as an object to be removed and selects a removal button 261 displayed on the setting image through the input device 130. In this manner, the operator can add or remove the pressure chamber as an object of the stretching operation.

A start button 270 for starting the stretching operation and an interruption button 271 for interrupting the stretching operation are displayed at the uppermost part of the setting image. The operator selects the start button 270 through the input device 130, thereby starting the stretching operation. The stretching operation started by operation of the operator is stretching operation by a manual mode. The operator selects the interruption button 271 through the input device 130, thereby interrupting the stretching operation.

FIG. 6 is a view showing a processing flow of the controller 40 which is operated by selecting the start button 270. As shown in step S101 in FIG. 6, the controller 40 judges whether a starting condition of the stretching operation by the manual mode is satisfied or not. For example, the controller 40 checks whether devices necessary for executing the stretching operation are operable or not and whether the polishing apparatus is in standby operation or not, i.e., whether the wafer W is actually processed or not.

When the controller 40 judges that the starting condition of the stretching operation is satisfied (see "YES" of step S101 in FIG. 6), steps S102-S107 in FIG. 6 are performed according to the program of stretching operation stored in the memory 110. The stretching operation of the elastic membrane 10 is performed in a state where the wafer W is not held by the polishing head 1, i.e., the wafer W is not brought in contact with the elastic membrane 10.

When the controller 40 judges that the starting condition of the stretching operation is not satisfied (see "NO" of step S101 in FIG. 6), interruption of the stretching operation (inexecution of the stretching operation) is determined (see step S108 in FIG. 6), and end processing is executed (see step S109 in FIG. 6).

As shown in FIGS. 6 and 7, the controller 40 executes a step (see step S102 in FIG. 6) for causing the arm motor 89 (swing device) to perform operation for moving the polishing head 1 coupled to the swingable head arm 64 from the standby position to the polishing position above the polishing pad 19. As a result, the polishing head 1 moves from the standby position outside the polishing table 18 to the polishing position above the polishing table 18.

After the step S102 in FIG. 6, i.e., after the polishing head 1 moves to the polishing position, the controller 40 executes a step (see step S103 in FIG. 6) for causing the vertically moving device 81 to perform operation for lowering the polishing head 1 attached to the vertically movable head shaft 27 from an upper position above the polishing pad 19 to a predetermined lower position. As a result, the polishing head 1 is lowered from the upper position to a predetermined lower position.

The predetermined lower position is determined by a membrane height which is defined by a distance between the surface 19*a* of the polishing pad 19 and the lower surface of the elastic membrane 10. The membrane height is a height from a position of the lower surface of the elastic membrane (reference position) to the surface of the polishing pad which is measured in a negative pressure state of the pressure chamber. When the reference position is determined, the membrane height is controlled by rotation of the ball screw 88. Therefore, the membrane height is determined based on the reference position without depending on the state of the pressure chamber.

The predetermined lower position may be a position where the elastic membrane 10 is brought into contact with the polishing pad 19 supported on the polishing table 18 when the pressurized fluid is supplied to the pressure chamber formed by the elastic membrane 10. According to one embodiment, the predetermined lower position may be a position where the membrane height is 0 mm, i.e., the lower surface of the elastic membrane 10 in a negative pressure state of the pressure chamber is brought into contact with the surface 19*a* of the polishing pad 19. According to another embodiment, the predetermined lower position may be a position where the lower surface of the elastic membrane 10 in a negative pressure state of the pressure chamber is separate from the surface 19*a* of the polishing pad 19 (i.e., position above the polishing table 18, more specifically, position above the polishing pad 19). For example, the membrane height may be determined to be a height in consideration of the thickness of the wafer W. In this case, the distance between the lower surface of the elastic membrane 10 in a negative pressure state of the pressure chamber and the surface 19*a* of the polishing pad 19 corresponds to the thickness of the wafer W.

After the step S103 in FIG. 6, the controller 40 executes a step (see step S104 in FIG. 6) for causing the pressure regulating device 65 to perform the stretching operation of the elastic membrane 10 a predetermined number of times.

The pressure regulating device 65 operates the pressure regulator and the opening and closing valve corresponding to the pressure chamber as an object of the stretching operation according to a command from the controller 40, thereby supplying the pressurized fluid to the pressure chamber. The pressure chamber becomes in a pressurized state by the supply of the pressurized fluid, and thus the elastic membrane 10 expands. After a lapse of a predetermined time, the pressure regulating device 65 stops the supply of the pressurized fluid according to a command from the controller 40 and operates the pressure release valve corresponding to the pressure chamber as the object of the stretching operation, thereby causing the pressure chamber to be open to the atmosphere. In this manner, by performing the stretching operation of the elastic membrane 10, the elastic membrane 10 becomes flexible, and the elasticity of the elastic membrane 10 can be enhanced.

In the embodiment shown in FIG. 7, the number of times of the stretching operation is once (i.e., the number of times that the pressurized fluid is supplied to the pressure chamber is once, and the number of times that the pressure chamber is open to the atmosphere is once). The stretching operation of the elastic membrane 10 may be repeated until desired elasticity (flexibility) can be ensured.

At the time of stretching operation, the cleaning liquid may be supplied onto the polishing pad 19 by opening the processing liquid supply valve 54 to prevent the polishing pad 19 from being dried.

At the time of stretching operation, the pressure of the pressurized fluid supplied to the pressure chamber is detected by a pressure detector such as a pressure sensor (not shown in the drawing), and pressure values detected by the pressure detector are transmitted to the controller 40. The controller 40 performs monitoring of abnormality of the pressure of the pressurized fluid supplied to the pressure chamber based on the detected pressure values, and issues an error alarm when the pressurized fluid has an abnormal pressure. Small holes for vacuum attraction of the wafer W are formed in the lower surface of the elastic membrane 10 for forming the intermediate pressure chamber 16*c*. Therefore, the pressurized fluid supplied to the intermediate pressure chamber 16*c* is slightly leaked to the outside through the small holes, and thus the controller 40 does not perform monitoring of pressure error of the intermediate pressure chamber 16*c*.

The controller 40 judges whether the stretching operation of the elastic membrane 10 is finished (completed) or not (see step S105 in FIG. 6), and executes a step (see step S106 in FIG. 6) for causing the vertically moving device 81 to perform operation for elevating the polishing head 1 after judging the completion of stretching operation (see "YES" of the step S105 in FIG. 6). As a result, as shown in FIG. 7, the polishing head 1 moves from the predetermined lower position to the predetermined upper position. When the stretching operation of the elastic membrane 10 is not completed, the controller 40 judges that the stretching operation is not completed (see "NO" of the step S105 in FIG. 6).

After the stretching operation of the elastic membrane is completed and the polishing head 1 is elevated, the controller 40 executes a step (see step S107 in FIG. 6) for causing the arm motor 89 (swing device) to perform operation for moving the polishing head 1 to the standby position. As a result, as shown in FIG. 7, the polishing head 1 moves from the polishing position to the standby position.

The program for causing the controller 40 to execute these steps is stored in the non-transitory tangible computer-readable storage medium, and is provided for the controller 40 through the storage medium. Alternatively, the program may be provided for the controller 40 through the communication network such as Internet.

In the case where the stretching operation is performed on a plurality of pressure chambers, according to one embodiment, the controller 40 may perform the stretching operation on the plural pressure chambers simultaneously. In this case, the controller 40 judges whether the stretching operation is completed or not after the stretching operation is performed on all of the pressure chambers as objects of the stretching operation.

According to another embodiment, the stretching operation may be performed on the plural pressure chambers in sequence. Specifically, when the stretching operation is performed on the plural pressure chambers in sequence, the controller 40 performs the stretching operation on one pressure chamber among all of the pressure chambers as objects of the stretching operation, and then judges whether the stretching operation of the one pressure chamber is completed or not. After judgement of the completion of the stretching operation, the controller 40 performs the stretching operation on the subsequent pressure chamber. That is, the controller 40 judges individually whether the stretching operation of each of the plural pressure chambers is completed or not.

In the above embodiments, the controller 40 performs the stretching operation of the elastic membrane 10 in a state where the polishing head 1 is lowered to the predetermined lower position. The effect achieved by this stretching operation is as follows. In the processing of actual wafer W, the elastic membrane 10 expands and contracts in a state where the wafer W is held by the polishing head 1, i.e., the wafer W is brought in contact with the elastic membrane 10. Therefore, the stretching operation of supplying the pressurized fluid to the pressure chamber formed by the elastic membrane 10 to cause the elastic membrane 10 to be brought into contact with the polishing pad 19 and allowing the pressure chamber to be open to the atmosphere after a lapse of a predetermined time is performed in a state where the polishing head 1 is brought in contact with the polishing pad 19. Thus, the elastic membrane 10 can be expanded and contracted in a condition close to the processing condition of the actual wafer W.

According to the present embodiment, when the controller 40 determines the start of the stretching operation through operation of the operator, the controller 40 performs the stretching operation automatically according to the program of stretching operation stored electrically in the memory 110. Therefore, it is not necessary to perform the stretching operation during processing of the wafer W (or dummy wafer), and thus the cost caused by the consumption of the wafer W (or dummy wafer) can be reduced and the elasticity of the elastic membrane 10 can be enhanced in a short time and efficiently.

As operation performed during standby operation of the polishing apparatus, operation referred to as dummy dispense (DDSP) can be cited. The dummy dispense is a cleaning process for keeping cleanliness of the interior of the processing liquid supply line 53 and the processing liquid supply nozzle 25 by opening the processing liquid supply nozzle 54 to flow the processing liquid (cleaning liquid or polishing liquid) periodically in the processing liquid supply line 53 and the processing liquid supply nozzle 25 during the standby operation of the polishing apparatus. In the present embodiment, the stretching operation of the elastic membrane 10 may be incorporated in the dummy dispense. Therefore, in the present embodiment, the dummy dispense includes the cleaning process for cleaning the processing liquid supply nozzle 25 and the processing liquid supply line 53 and the stretching operation of the elastic membrane 10.

The operating conditions of the stretching operation (e.g., the number of times of the stretching operation and duration time of the stretching operation) is introduced into the controller 40 in advance. FIG. 8 is a view showing a setting image of the dummy dispense which relates to the operating conditions of the stretching operation of the elastic membrane 10 introduced into the controller 40.

The setting image of the dummy dispense shown in FIG. 8 can be displayed on the display screen of the display device 141 of the controller 40. A column 200 for showing items which display supply of pressurized fluid (Membrane Break-in in FIG. 8), membrane height (Membrane Height in FIG. 8), time when the pressure chamber is open to the atmosphere (Time to Free Air Bag in FIG. 8), and pressure chambers as objects of the stretching operation (Area 1-8 Air Bag in FIG. 8), a column 201 for showing line items which display setting items with respect to the items displayed in the column 200 (e.g., non-operating time (Interval Time in FIG. 8) of the stretching operation, setting values, and repeat count of the stretching operation), a column 202 for showing the number of decimal places (NODP) of the setting values, a column 203 for showing initial values, a column 204 for showing maximum setting values, and a column 205 for showing minimum setting values are displayed on the setting image of the dummy dispense.

The operator can set values of the setting items on the setting image of the dummy dispense, which is displayed on the display screen of the display device 141, through the input device 130. In FIG. 8, concrete numerical values are not displayed in the above columns 202, 203, 204 and 205.

Figure 9:
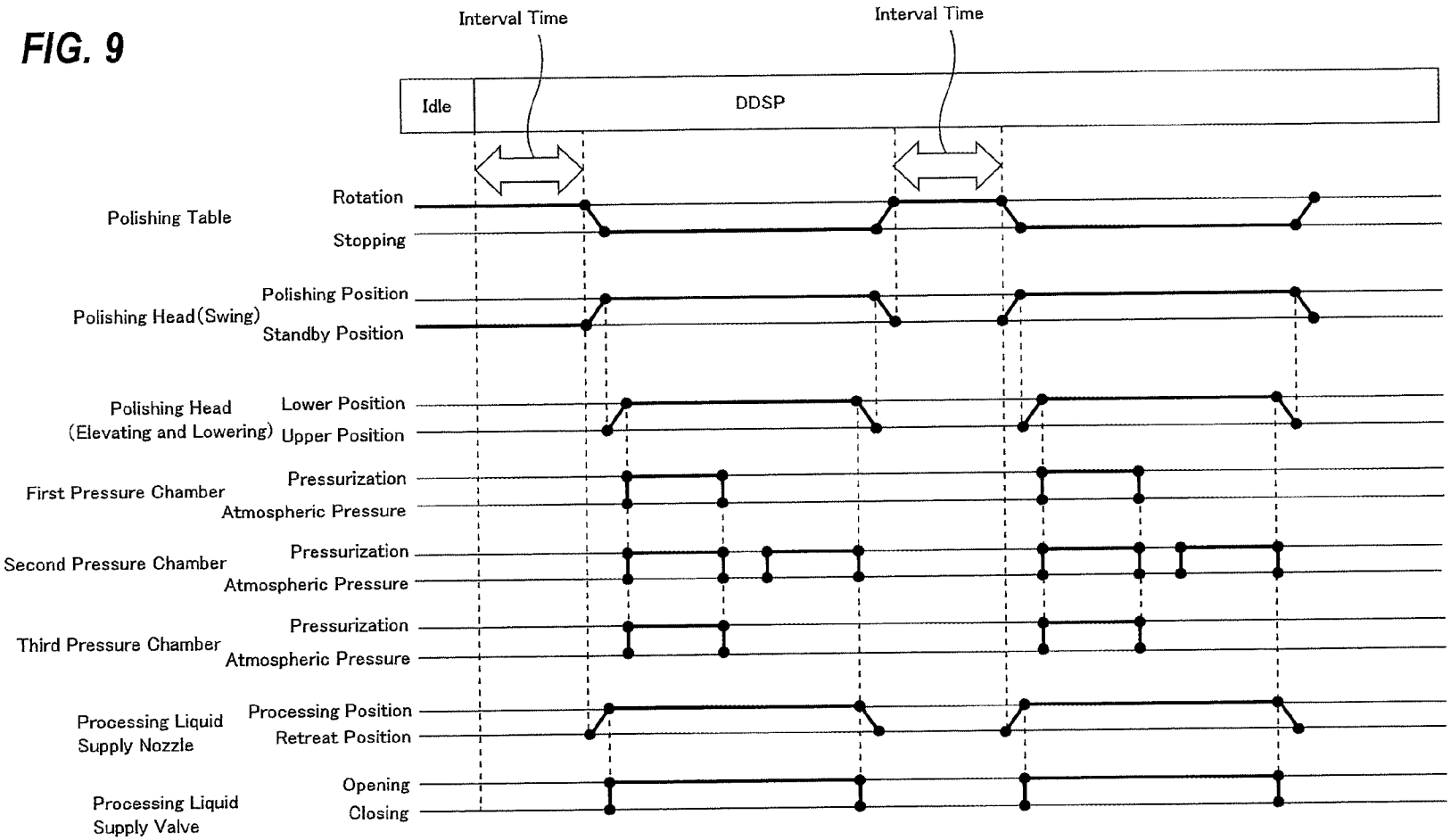
FIG. 9 is a view showing the dummy dispense incorporated in the stretching operation of the elastic membrane.

FIG. 9 is a view showing the dummy dispense incorporated in the stretching operation of the elastic membrane 10. In FIG. 9, a first pressure chamber, a second pressure chamber and a third pressure chamber are respective different pressure chambers, and the first pressure chamber, the second pressure chamber and the third pressure chamber are selected from the above pressure chambers 12, 14*a*, 14*b*, and 16*a*-16*e*, respectively. In FIG. 9, the stretching operation for the three pressure chambers will be described. However, the number of pressure chambers as objects of the stretching operation is not limited to the embodiment shown in FIG. 9.

As shown in FIG. 9, the dummy dispense including the cleaning process and the stretching operation is automatically started after a lapse of a predetermined idle time of the polishing apparatus. The stretching operation which is automatically started after a lapse of a predetermined idle time is stretching operation by an automatic mode. If the idle time lasts for a long period of time, the elastic membrane 10 becomes hardened, and the degree of expansion of the elastic membrane 10 when the pressure chamber is pressurized changes to cause polishing profile of the wafer W to be changed. Thus, the surface of the wafer W cannot be polished stably. Therefore, the idle time is determined so that the polishing profile of the wafer W is not changed.

During the idle time of the polishing apparatus, the polishing table 18 continues to be rotated, and the polishing head 1 is in standby position. After a lapse of a predetermined idle time, the controller 40 performs the dummy dispense except for the stretching operation. More specifically, the controller 40 causes the flushing device to perform the cleaning process for cleaning the processing liquid supply line 53 and the processing liquid supply nozzle 25. In other words, the controller 40 performs the cleaning process by operating the processing liquid supply valve 54. This cleaning process is performed during non-operating time (interval time) of the stretching operation. The object of the stretching operation includes prevention of hardening of the elastic membrane 10. Therefore, the interval time is determined in consideration of an interval of time which can keep proper elasticity of the elastic membrane 10 without causing hardening of the elastic membrane 10. If there is no interval time, the stretching operation is continuously performed for a long period of time to prolong the time of the stretching operation, and thus the elastic membrane 10 is forced to expand more than necessary, thus shortening a service life of the elastic membrane 10. Therefore, the interval time should be set, and the interval of time of the stretching operation is determined so that the proper elasticity of the elastic membrane 10 can be kept.

The processing liquid (cleaning liquid or polishing liquid) which has been used in the cleaning process may be supplied onto the polishing pad 19 or may be supplied to a drain (not shown) disposed outside the polishing pad 19.

As shown in FIG. 9, after the cleaning process is completed, the controller 40 causes the polishing head 1 to move from the standby position to the polishing position above the polishing pad 19 by the arm motor 89 while causing the table motor 29 to perform operation for stopping the rotation of the polishing table 18. When the polishing head 1 starts to move to the polishing position, at the same time, the processing liquid supply nozzle 25 starts to move from the retreat position to the processing position above the polishing pad 19 by the nozzle motor 52. When the processing liquid supply nozzle 25 reaches the processing position, the controller 40 controls the processing liquid supply valve 54 to open, so that the cleaning liquid is supplied from the processing liquid supply nozzle 25 onto the polishing pad 19 to prevent the polishing pad 19 from being dried.

The polishing head 1 is lowered from a predetermined upper position above the polishing pad 19 to a predetermined lower position by the vertically moving device 81, and then the stretching operation of the elastic membrane 10 is started. The supply of the cleaning liquid onto the polishing pad 19 is continued while this stretching operation is performed.

In the embodiment shown in FIG. 9, the stretching operation of the first pressure chamber and the stretching operation of the third pressure chamber are performed only once, respectively, and the stretching operation of the second pressure chamber is performed twice. In the case where the stretching operation is repeated more than once, the time when the pressure chamber is open to the atmosphere may be common to all of the stretching operation or may be different in each of the stretching operation.

The stretching operation of the first pressure chamber, the stretching operation of the second pressure chamber and the stretching operation of the third pressure chamber are started simultaneously and in parallel. After the stretching operation of all of the pressure chambers is completed, the processing liquid supply valve 54 is closed and the polishing head 1 is moved from the lower position to the upper position, and at the same time, the processing liquid supply nozzle 25 is moved from the processing position to the retreat position.

The polishing head 1 is moved from the polishing position to the standby position outside the polishing table 18 by the arm motor 89. When the polishing head 1 starts to move to the standby position, the polishing table 18 starts to rotate again. Thereafter, the cleaning process is started again. Specifically, non-operating time of the stretching operation is counted. In this manner, the cleaning process and the stretching operation are alternately repeated. Although the stretching operation is performed after the cleaning process in the present embodiment, the stretching operation may be performed before the cleaning process. The stretching operation is performed before and/or after the cleaning process.

The above description of embodiments is provided to enable a person skilled in the art to make and use the present invention. Moreover, various modifications to these embodiments will be readily apparent to those skilled in the art, and the generic principles and specific examples defined herein may be applied to other embodiments. For example, the controller may perform the stretching operation of the elastic membrane by operating the pressure regulating device in a state where the polishing head is in the standby position. The present invention is not intended to be limited to the embodiments described herein but is to be accorded the widest scope as defined by limitation of the claims.

What is claimed is:

1. A non-transitory computer-readable storage medium storing a program of a stretching operation of an elastic membrane in a substrate holding apparatus, the program for causing a computer to perform steps comprising:

performing a stretching operation of supplying a pressurized fluid to a pressure chamber formed by the elastic membrane and allowing the pressure chamber to be open to the atmosphere a predetermined number of times by a pressure regulating device in a state where the substrate holding apparatus is positioned above a polishing table while a substrate is not held by the substrate holding apparatus during a standby operation of a polishing apparatus.

2. The storage medium according to claim 1, the program for causing the computer to perform steps further comprising:

performing an operation of moving the substrate holding apparatus coupled to a swingable head arm from a standby position to a position above the polishing table by a swing device;

performing an operation of lowering the substrate holding apparatus attached to a vertically movable head shaft to a predetermined lower position by a vertically moving device;

performing the stretching operation by the pressure regulating device;

performing an operation of elevating the substrate holding apparatus by the vertically moving device after completion of the stretching operation; and performing an operation of moving the substrate holding apparatus to the standby position of the substrate holding apparatus by the swing device.

3. The storage medium according to claim 2, wherein the predetermined lower position is a position where the elastic membrane is brought into contact with a polishing pad supported by the polishing table at the time of supplying the pressurized fluid to the pressure chamber formed by the elastic membrane.

4. The storage medium according to claim 1, the program for causing the computer to perform steps further comprising:

performing a cleaning process for cleaning a processing liquid supply line by a flushing device; and performing the stretching operation by the pressure regulating device before and/or after the cleaning process.

5. The storage medium according to claim 1, the program for causing the computer to perform steps further comprising: performing the stretching operation when replacing the elastic membrane.

6. The storage medium according to claim 1, the program for causing the computer to perform steps further comprising: performing an operation of supplying a cleaning liquid onto a polishing pad by opening a processing liquid supply valve at the time of stretching operation.

7. The storage medium according to claim 1, the program for causing the computer to perform steps further comprising: performing an operation of monitoring an abnormality of a pressure of the pressurized fluid supplied to the pressure chamber based on a detected pressure value by a pressure detector.

8. A method of stretching operation of an elastic membrane in a substrate holding apparatus, comprising:

performing a stretching operation of supplying a pressurized fluid to a pressure chamber formed by the elastic membrane and allowing the pressure chamber to be open to the atmosphere a predetermined number of times in a state where the substrate holding apparatus is positioned above a polishing table while a substrate is not held by the substrate holding apparatus during a standby operation of a polishing apparatus.

9. The method according to claim 8, further comprising:

moving the substrate holding apparatus coupled to a swingable head arm from a standby position to a position above the polishing table;

lowering the substrate holding apparatus attached to a vertically movable head shaft to a predetermined lower position;

performing the stretching operation;

elevating the substrate holding apparatus by the head shaft after completion of the stretching operation; and moving the substrate holding apparatus to the standby position by the head arm.

10. The method according to claim 9, wherein the predetermined lower position is a position where the elastic membrane is brought into contact with a polishing pad supported by the polishing table at the time of supplying the pressurized fluid to the pressure chamber formed by the elastic membrane.

11. The method according to claim 8, further comprising:

performing a cleaning process for cleaning a processing liquid supply line; and performing the stretching operation before and/or after the cleaning process.

12. The method according to claim 8, further comprising: performing the stretching operation when replacing the elastic membrane.

13. The method according to claim 8, further comprising: supplying a cleaning liquid onto a polishing pad by opening a processing liquid supply valve at the time of stretching operation.

14. The method according to claim 8, further comprising: monitoring an abnormality of a pressure of the pressurized fluid supplied to the pressure chamber based on a detected pressure value by a pressure detector.

* * * * *